US009897390B2

(12) United States Patent
Yu et al.

(10) Patent No.: US 9,897,390 B2
(45) Date of Patent: Feb. 20, 2018

(54) FIXING STRUCTURE FOR HEAT DISSIPATION ELEMENT

(71) Applicant: ASIA VITAL COMPONENTS CO., LTD., New Taipei (TW)

(72) Inventors: Ming-Han Yu, New Taipei (TW); Jing-Ning Wu, New Taipei (TW); Sheng-Pei Lee, New Taipei (TW); Chun-Ming Wu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 293 days.

(21) Appl. No.: 14/660,890

(22) Filed: Mar. 17, 2015

(65) Prior Publication Data

US 2016/0273844 A1 Sep. 22, 2016

(51) Int. Cl.

| | |
|---|---|
| ***F28F 7/00*** | (2006.01) |
| ***F28D 15/02*** | (2006.01) |
| ***F28D 15/04*** | (2006.01) |

(52) U.S. Cl.

CPC ..... *F28D 15/0275* (2013.01); *F28D 15/0233* (2013.01); *F28D 15/04* (2013.01); *F28F 2275/12* (2013.01)

(58) Field of Classification Search

CPC ..... F28D 15/0275; H01L 23/427

See application file for complete search history.

(56) References Cited

U.S. PATENT DOCUMENTS 4,576,221 A * 3/1986 Fennesz ..... F24D 3/14 165/168
2013/0228311 A1* 9/2013 Wu ..... B21D 53/02 165/104.26

FOREIGN PATENT DOCUMENTS

| | | | | |
|---|---|---|---|---|
| CN | 202150085 U | | 2/2012 | |
| CN | 103002707 A | | 3/2013 | |
| CN | 203224159 U | | 10/2013 | |
| CN | 204392760 U | | 6/2015 | |
| JP | 2000304476 A | * | 11/2000 | ..... F28D 15/02 |
| JP | 201336718 A | | 2/2013 | |
| TW | M1506273 U | | 8/2015 | |

OTHER PUBLICATIONS

Fukumiya, JP 2000-304476, Nov. 2, 2000, machine translation.*

* cited by examiner

*Primary Examiner* — Hung Q Nguyen
*Assistant Examiner* — Mark L Greene
(74) *Attorney, Agent, or Firm* — Nikolai & Mersereau, P.A.; C. G. Mersereau

(57) ABSTRACT

A fixing structure for heat dissipation element includes a base plate, a heat transfer element, and at least one fixing member. The base plate has a top surface, on which a receiving recess is defined for receiving the heat transfer element therein. At least one clearance is defined between the receiving recess and the heat transfer element. The fixing member has a fixing portion and an extended portion. The fixing portion is connected to the top surface of the base plate, whereas the extended portion is bent and inserted into the clearance to locate between the receiving recess and the heat transfer element, such that the heat transfer element is firmly held in the receiving recess of the base plate.

12 Claims, 16 Drawing Sheets

FIXING STRUCTURE FOR HEAT DISSIPATION ELEMENT

FIELD OF THE INVENTION

The present invention relates to a heat dissipation element, and more specifically, to a fixing structure for heat dissipation element.

BACKGROUND OF THE INVENTION

Generally, a fixing structure for heat dissipation element includes a base plate and a heat pipe. The base plate defines a receiving recess for receiving the heat pipe therein. The heat pipe is connected to the receiving recess by tight fitting or loose fitting. In the case of tight fitting, the heat pipe has an outer diameter or a width larger than an inner diameter or a width of the receiving recess, so the heat pipe tends to be damaged when being connected to the receiving recess or could not be easily successfully connected to the receiving recess. On the other hand, in the case of loose fitting, glue or solder is needed to bond or weld the heat pip to the receiving recess. In other words, additional steps are required in the whole manufacturing process to connect the heat pipe to the receiving recess. Therefore, there are problems of lengthened production process, increased manufacturing cost and potential environmental pollution.

It is therefore tried by the inventor to develop an improved fixing structure for heat dissipation element that can prevent the heat pipe from being damaged when being connected to the receiving recess, and shorten the production process, as well as reduce the manufacturing cost.

SUMMARY OF THE INVENTION

To solve the above problems, a primary object of the present invention is to provide a fixing structure for heat dissipation element that enables a heat transfer element to be tightly fitted in a receiving recess by inserting a fixing member into at least one clearance between the receiving recess and the heat transfer element.

Another object of the present invention is to provide a fixing structure for heat dissipation element that can prevent a heat transfer element from being damaged when being connecting to a receiving recess, and enables shortened manufacturing process and reduced manufacturing cost of the fixing structure.

A further object of the present invention is to provide a fixing structure for heat dissipation element that has a base plate provided with a shallow recess for receiving at least one fixing member therein.

To achieve the above and other objects, the fixing structure for heat dissipation element according to the present invention includes a heat transfer element, a base plate, and at least one fixing member. The heat transfer element has two opposite outer lateral sides, and a width of the heat transfer element is defined between the two opposite outer lateral sides. The base plate has a top surface, on which a receiving recess is defined for receiving the heat transfer element therein. The receiving recess has a top opening and two opposite inner lateral sides located corresponding to the two opposite outer lateral sides of the heat transfer element, and a width of the receiving recess is defined between the two opposite inner lateral sides and is larger than the width of the heat transfer element. At least one clearance is defined between the two inner lateral sides of the receiving recess and the two outer lateral sides of the heat transfer element.

The at least one fixing member has a fixing portion connected to the top surface of the base plate, and an extended portion extended from the fixing portion. The extended portion is bent and inserted into the clearance to locate between the receiving recess and the heat transfer element, bringing the heat transfer element to be tightly held in the receiving recess.

More specifically, the fixing structure for heat dissipation element according to the present invention includes a heat transfer element, a base plate, and a first fixing member. The heat transfer element has an outer surface, on which a first and a second outer lateral side are defined, and a width of the heat transfer element is defined between the first and the second outer lateral side. The base plate has a top surface, on which a receiving recess is defined for receiving the heat transfer element therein. The receiving recess has a top opening, a first inner lateral side, and a second inner lateral side located opposite to the first inner lateral side. The first inner lateral side is located corresponding to the first outer lateral side of the heat transfer element, whereas the second inner lateral side is located corresponding to the second outer lateral side of the heat transfer element. A width of the receiving recess is defined between the first and the second inner lateral side and is larger than the width of the heat transfer element, such that a first clearance is defined between the first inner lateral side of the receiving recess and the first outer lateral side of the heat transfer element. The first fixing member is connected to the top surface of the base plate, and has a first fixing portion and a first extended portion extended from the first fixing portion. The first fixing portion is connected to the top surface of the base plate, whereas the first extended portion is bent and inserted into the first clearance, such that the first extended portion is tightly fitted between the first inner lateral side of the receiving recess and the first outer lateral side of the heat transfer element.

In an embodiment of the present invention, the base plate further has a first shallow recess defined on the top surface and located adjacent to one outer side of the top opening of the receiving recess. The receiving recess has a depth larger than a depth of the first shallow recess; and the first fixing portion of the first fixing member is fitted in the first shallow recess.

In an embodiment of the present invention, the fixing structure for heat dissipation element further includes a second fixing member, which has a second fixing portion connected to the top surface of the base plate and a second extended portion extended from the second extended portion into the top opening of the receiving recess.

In an embodiment of the present invention, a second clearance is defined between the second inner lateral side of the receiving recess and the second outer lateral side of the heat transfer element; and the second extended portion of the second fixing member is bent and inserted into the second clearance, such that the second extended portion is tightly fitted between the second inner lateral side of the receiving recess and the second outer lateral side of the heat transfer element.

In an embodiment of the present invention, the base plate further has a first and a second shallow recess defined on the top surface and located adjacent to two outer sides of the top opening of the receiving recess. The first and the second shallow recess respectively have a depth smaller than that of the receiving recess; and the first fixing portion of the first fixing member is fitted in the first shallow recess, whereas the second fixing portion of the second fixing member is fitted in the second shallow recess.

In an embodiment of the present invention, the second extended portion of the second fixing member has a free edge pressed against the outer surface of the heat transfer element.

In an embodiment of the present invention, the heat transfer element is a heat pipe or a vapor chamber.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
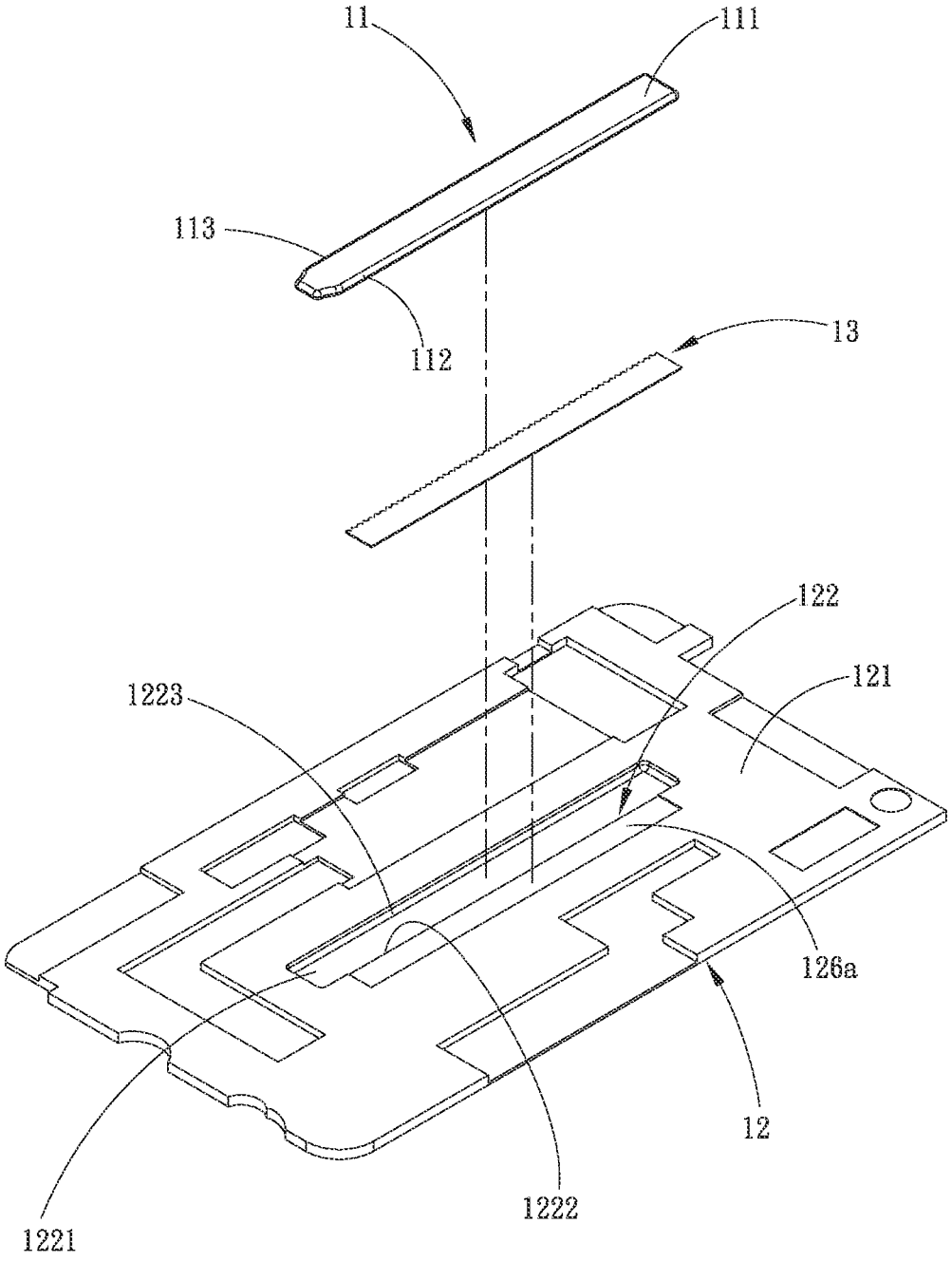
FIG. 1A is a fully exploded perspective view of a fixing structure for heat dissipation element according to a first embodiment of the present invention.

The present invention relates to a fixing structure for heat dissipation element that includes a heat transfer element, a base plate, and at least one fixing member. The heat transfer element has two opposite outer lateral sides, and a width of the heat transfer element is defined between the two opposite outer lateral sides. The base plate has a top surface, on which a receiving recess is defined for receiving the heat transfer element therein. The receiving recess has a top opening and two opposite inner lateral sides located corresponding to the two opposite outer lateral sides of the heat transfer element. A width of the receiving recess is defined between the two opposite inner lateral sides and is larger than the width of the heat transfer element. At least one clearance is defined between the two opposite inner lateral sides of the receiving recess and the two outer lateral sides of the heat transfer element. The at least one fixing member has a fixing portion connected to the top surface of the base plate and an extended portion extended from the fixing portion. The extended portion is bent and inserted into the clearance to locate between the receiving recess and the heat transfer element, bringing the heat transfer element to be tightly held in the receiving recess.

The present invention will now be described with some preferred embodiments thereof and by referring to the accompanying drawings. For the purpose of easy to understand, elements that are the same in the preferred embodiments are denoted by the same reference numerals.

Figure 1B:
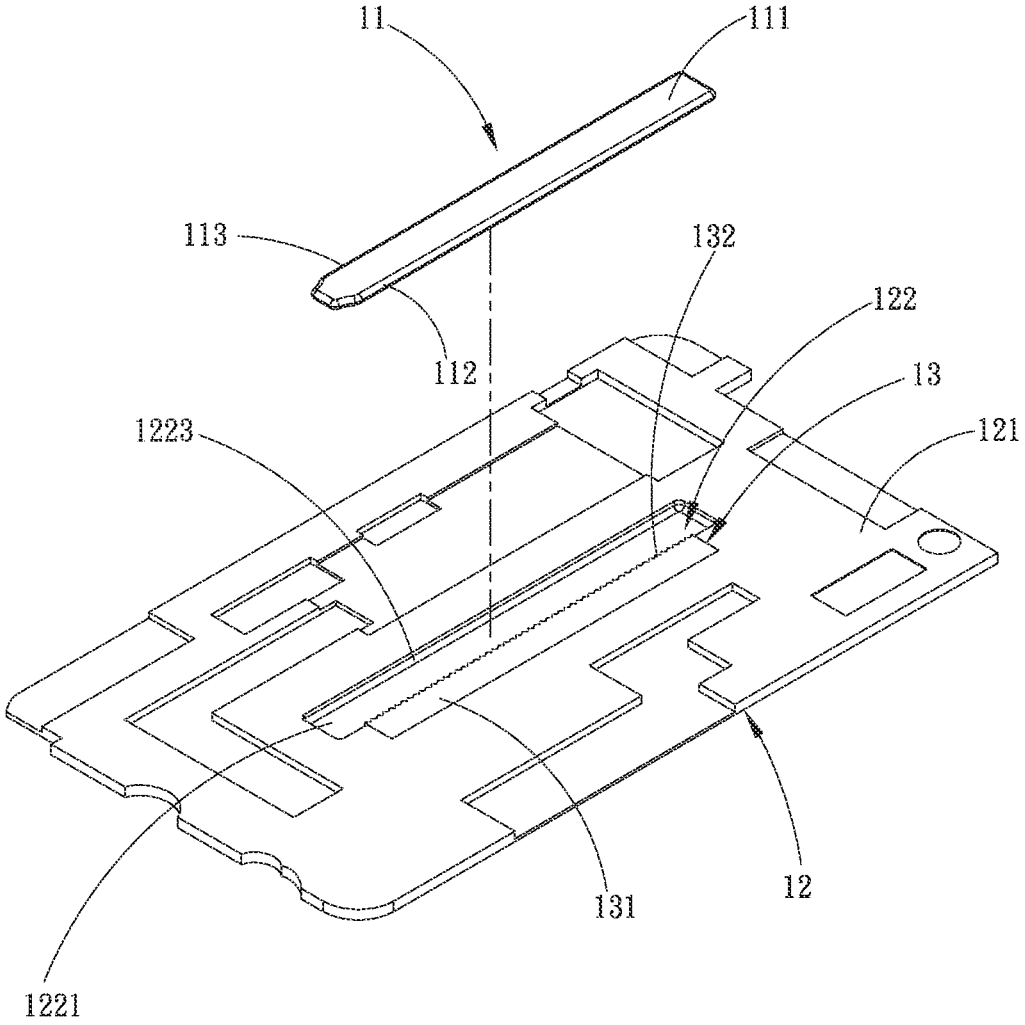
FIG. 1B is a partially assembled perspective view of FIG. 1A.
Figure 1C:
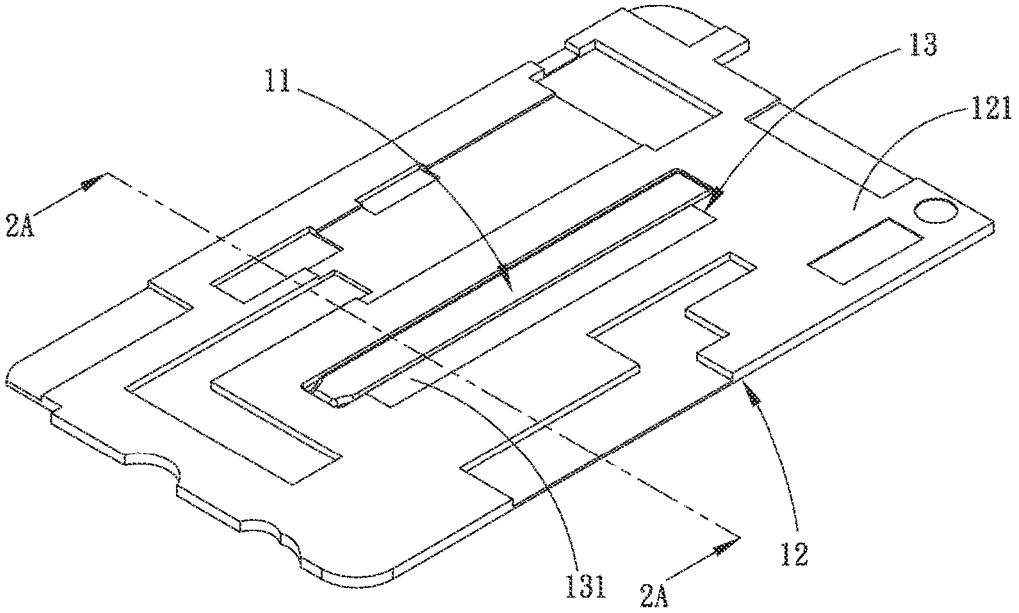
FIG. 1C is a fully assembled perspective view of FIG. 1A.
Figure 2A:
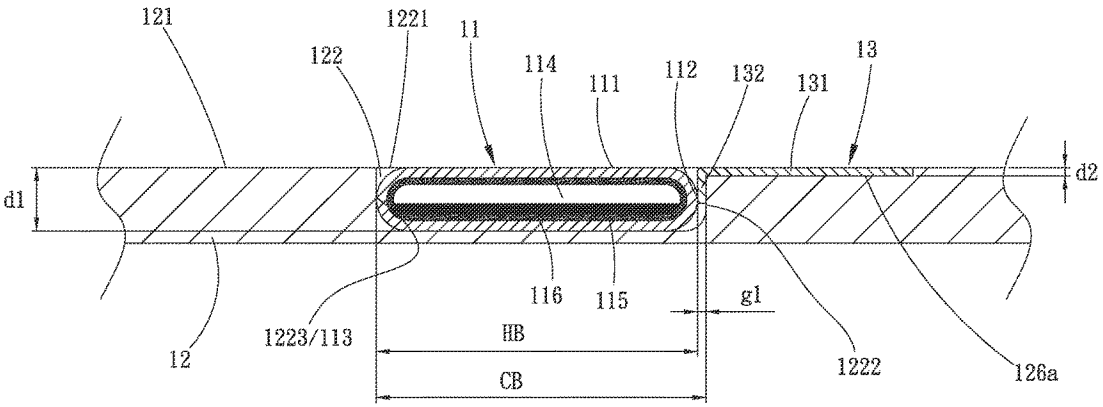
FIG. 2A is a fragmentary assembled sectional view taken along line 2A-2A of FIG. 1C.

Please refer to FIGS. 1A to 1C, which are fully exploded, partially assembled, and fully assembled perspective views, respectively, of a fixing structure for heat dissipation element according to a first embodiment of the present invention, and to FIG. 2A, which is a fragmentary assembled sectional view taken along line 2A-2A of FIG. 1C. For the purpose of conciseness, the present invention is also briefly referred to as the fixing structure herein. As shown, the fixing structure in the first embodiment includes a heat transfer element 11, a base plate 12, and a first fixing member 13. The heat transfer element 11 has an outer surface 111; two opposite sides of which are defined as a first and a second outer lateral side 112, 113; and a heat transfer element width HB is defined between the first and the second outer lateral side 112, 113. The first outer lateral side 112 of the heat transfer element 11 can be, for example but not limited to, a rightmost side of the heat transfer element 11, whereas the second outer lateral side 113 of the heat transfer element 11 can be, for example but not limited to, a leftmost side of the heat transfer element 11. The heat transfer element 11 can be, for example but not limited to, a heat pipe or a vapor chamber and internally defines a chamber 114, in which a wick structure 115 and a working fluid 116 are provided. Either the heat pipe or the vapor chamber dissipates heat mainly through a vapor-liquid circulation occurred therein. More specifically, both the heat pipe and the vapor chamber have an evaporating and a condensing end. The evaporating end is in contact with a heat generating element, such that the working fluid 116 located at the evaporating end is heated and vaporized. The vaporized working fluid 116 flows through the chamber 114 to the condensing end, at where the working fluid 116 is condensed into liquid. The liquid working fluid 116 then flows back to the evaporating end with the help of a capillary force of the wick structure 115. Since the heat pipe and the vapor chamber are known in the art, they are not discussed in more details herein.

The base plate 12 can be, for example but not limited to, a middle frame or a back case of a cell phone or a tablet computer, or a heat spreader provided in an electronic device, such as a personal computer (PC) or a smart wearable device. The base plate 12 has a top surface 121, on which a receiving recess 122 is defined for receiving the heat transfer element 11 therein. The receiving recess 122 has a top opening 1221, a first inner lateral side 1222 and a second inner lateral side 1223 opposite to the first inner lateral side 1222. The first inner lateral side 1222 is located corresponding to the first outer lateral side 112 of the heat transfer element 11, whereas the second inner lateral side 1223 is located corresponding to the second outer lateral side 113 of the heat transfer element 11. A receiving recess width CB is defined between the first and the second inner lateral side 1222, 1223 and is slightly larger than the heat transfer element width HB, as can be seen in FIG. 2A. Furthermore, in the illustrated first embodiment, a first clearance g1 is defined between the first inner lateral side 1222 of the receiving recess 122 and the first outer lateral side 112 of the heat transfer element 11, and the second outer lateral side 113 of the heat transfer element 11 is in contact with the second inner lateral side 1223 of the receiving recess 122.

The first fixing member 13 is connected to the top surface 121 of the base plate 12 to locate adjacent to one side of the top opening 1221 of the receiving recess 122. In the illustrated first embodiments, the first fixing member 13 is located to a right side of the top opening 1221 of the receiving recess 122. The first fixing member 13 has a first fixing portion 131 and a first extended portion 132 extended from one side of the first fixing portion 131. The first fixing portion 131 is connected to the top surface 121 of the base plate 12, whereas the first extended portion 132 of the first fixing member 13 is bent and inserted into the first clearance g1, such that the first extended portion 132 of the first fixing member 13 is tightly fitted between the first inner lateral side 1222 of the receiving recess 122 and the first outer lateral side 112 of the heat transfer element 11.

Furthermore, a first shallow recess 126*a* is also defined on the top surface 121 of the base plate 12 to locate adjacent to one outer side of the top opening 1221 of the receiving recess 122. In the illustrated first embodiment, the first shallow recess 126*a* is located adjacent to a right outer side of the top opening 1221 of the receiving recess 122. The receiving recess 122 has a depth d1 defined between the top surface 121 of the base plate 12 and a bottom of the receiving recess 122, whereas the first shallow recess 126*a* has a depth d2 defined between the top surface 121 of the base plate 12 and a bottom of the first shallow recess 126*a*. Moreover, the depth d1 of the receiving recess 122 is larger than the depth d2 of the first shallow recess 126*a*. The first fixing portion 131 of the first fixing member 13 is fitted in the first shallow recess 126*a*, and has a thickness equal to or smaller than the depth d2 of the first shallow recess 126*a*, so that a top surface of the first fixing portion 131 of the first fixing member 13 fitted in the first shallow recess 126*a* is not higher than the top surface 121 of base plate 12.

Figure 2B:
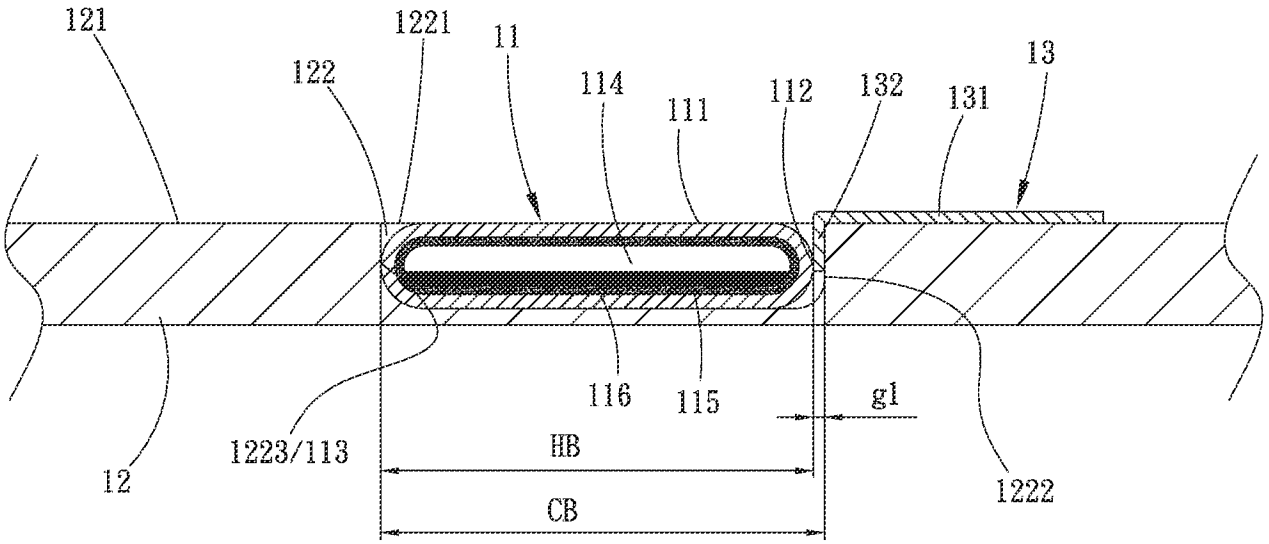
FIG. 2B is a fragmentary assembled sectional view of the fixing structure for heat dissipation element according to a second embodiment of the present invention.

Alternatively, as shown in FIG. 2B, which is a fragmentary assembled sectional view of the fixing structure for heat dissipation element according to a second embodiment of the present invention, the first fixing portion 131 of the first fixing member 13 can be directly connected to the top surface 121 of the base plate 12 without the need of providing a shallow recess on the base plate 12.

More specifically, the first fixing portion 131 of the first fixing member 13 is connected to the top surface 121 of the base plate 12 or fitted in the first shallow recess 126*a* by riveting, welding, bonding, spot welding, hooking, or snap fitting.

In the illustrated first embodiment, the first extended portion 132 of the first fixing member 13 is tightly fitted between the first inner lateral side 1222 of the receiving recess 122 and the first outer lateral side 112 of the heat transfer element 11, causing the heat transfer element 11 to be tightly held in the receiving recess 122. In other words, a sum of a thickness of the first extended portion 132 and the width HB of the heat transfer element 11 is slightly larger than the width CB of the receiving recess 122, so that the first extended portion 132 and the heat transfer element 11 can be tightly fitted in the receiving recess 122.

Figure 3A:
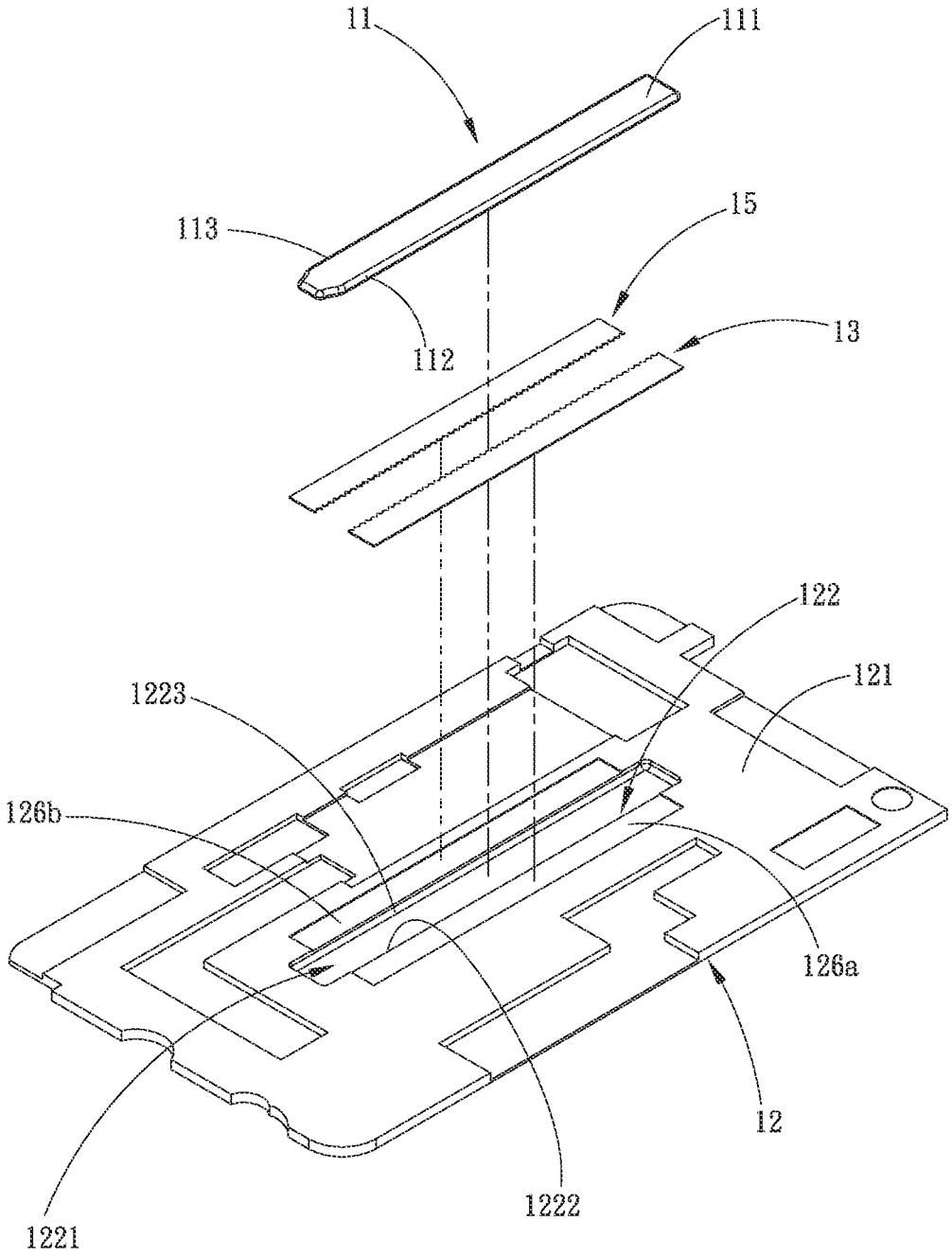
FIG. 3A is a fully exploded perspective view of the fixing structure for heat dissipation element according to a third embodiment of the present invention.
Figure 3B:
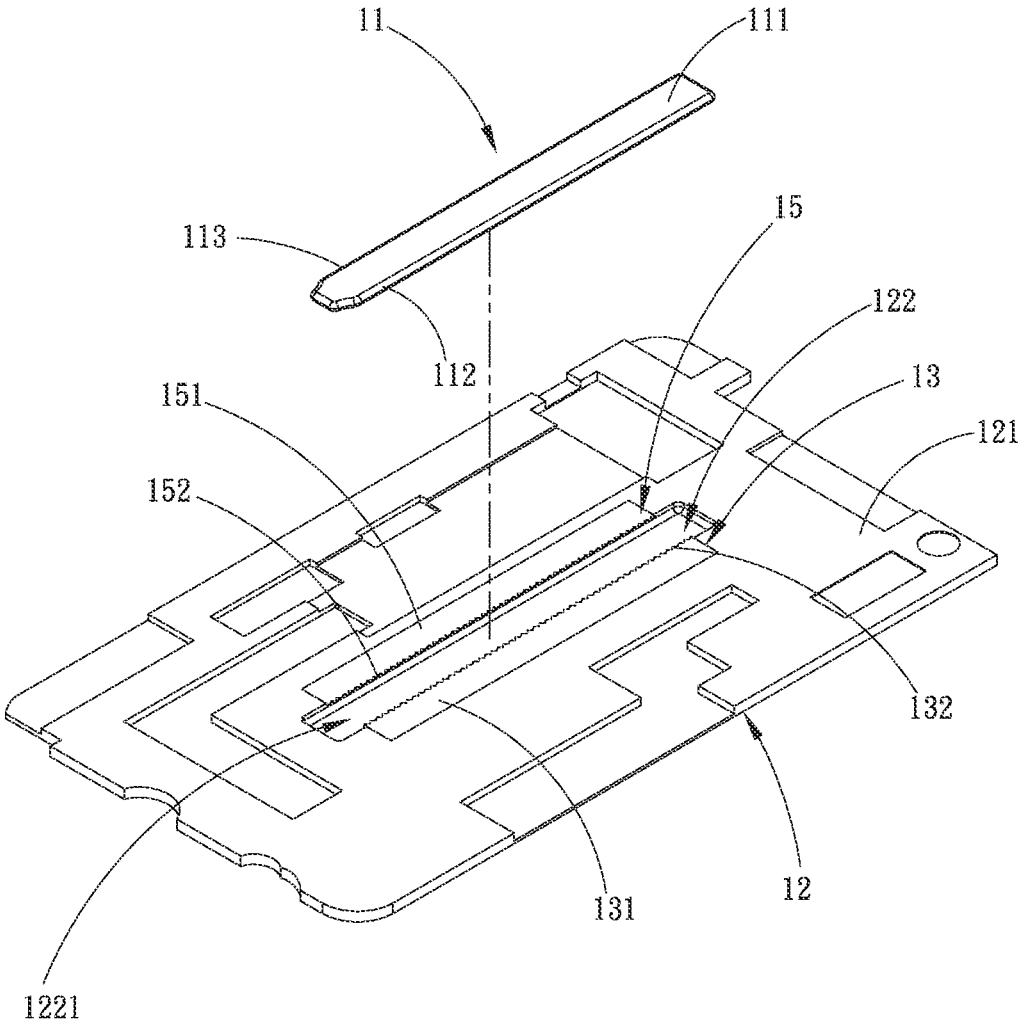
FIG. 3B is a partially assembled perspective view of FIG. 3A.
Figure 3C:
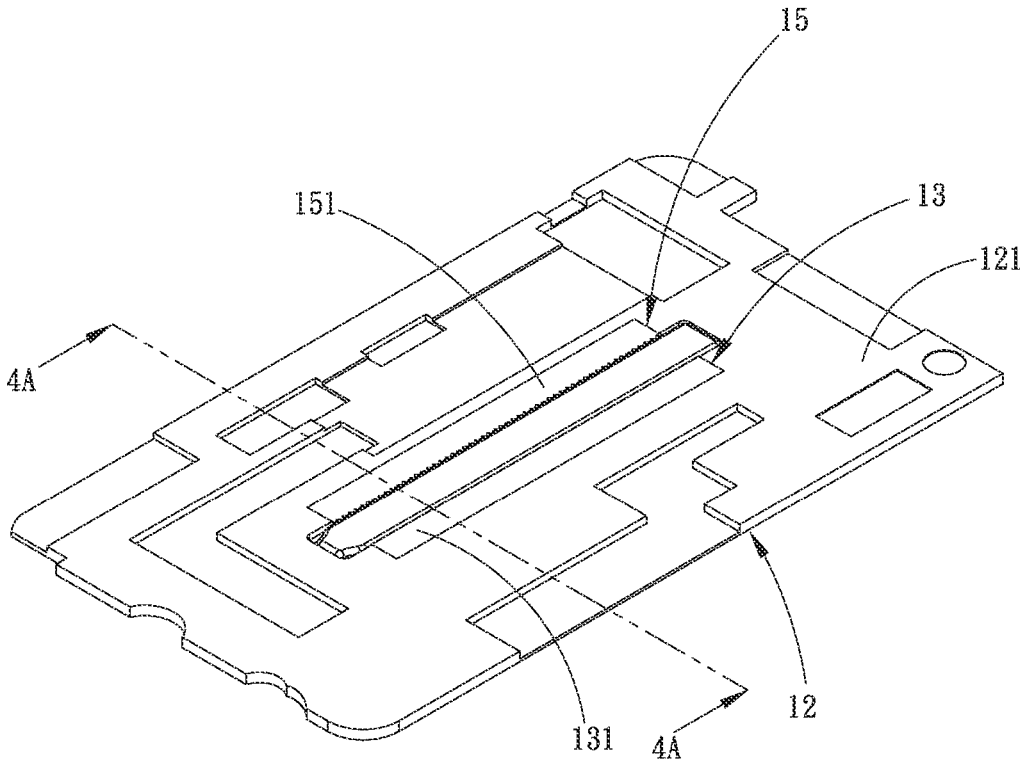
FIG. 3C is a fully assembled perspective view of FIG. 3A.
Figure 4A:
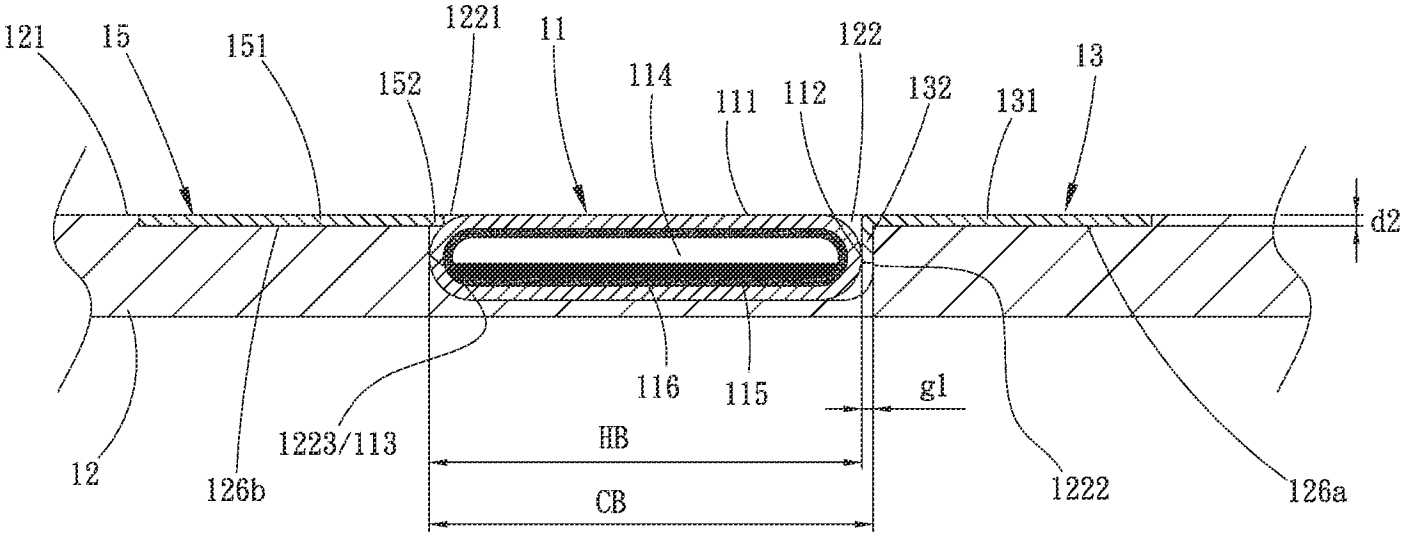
FIG. 4A is a fragmentary sectional view taken along line 4A-4A of FIG. 3C.

Please refer to FIGS. 3A to 3C, which are fully exploded, partially assembled, and fully assembled perspective views, respectively, of the fixing structure according to a third embodiment of the present invention, and to FIG. 4A, which is a fragmentary assembled sectional view taken along line 4A-4A of FIG. 3C. As shown, the fixing structure in the third embodiment further includes a second fixing member 15. In the illustrated third embodiment, the first and the second fixing member 13, 15 are respectively located to a right and a left outer side of the top opening 1221 of the receiving recess 122. The second fixing member 15 has a second fixing portion 151 and a second extended portion 152. The second fixing portion 151 is connected to the top surface 121 of the base plate 12, whereas the second extended portion 152 is extended from the second fixing portion 151 into the top opening 1221 of the receiving recess 122, as shown in FIG. 4A. The second extended portion 152 is extended beyond a contact surface between the second inner lateral side 1223 of the receiving recess 122 and the second outer lateral side 113 of the heat transfer element 11, such that a free edge 1521 of the second extended portion 152 is pressed against the outer surface 111 of the heat transfer element 11, preventing the second outer lateral side 113 of the heat transfer element 11 from moving out of the receiving recess 122.

Moreover, a first and a second shallow recess 126*a*, 126*b* are defined on the top surface 121 of the base plate 12 to locate adjacent to two lateral outer sides of the top opening 1221 of the receiving recess 122. The first and the second shallow recess 126*a*, 126*b* respectively have a depth d2 defined between the top surface 121 of the base plate 12 and a bottom of the first and of the second shallow recess 126*a*, 126*b*.

Further, the depth d1 of the receiving recess 122 is larger than the depth d2 of the first and the second shallow recess 126*a*, 126*b*. The first fixing portion 131 of the first fixing member 13 and the second fixing portion 151 of the second fixing member 15 are respectively fitted in the first and the second shallow recess 126*a*, 126*b*. The first fixing member 13 and the second fixing member 15 respectively have a thickness equal to or smaller than the depth d2 of the first and the second shallow recess 126*a*, 126*b*, so that top surfaces of the first and second fixing portions 131, 151 fitted in the first and second shallow recesses 126*a*, 126*b* are not higher than the top surface 121 of the base plate 12.

Figure 4B:
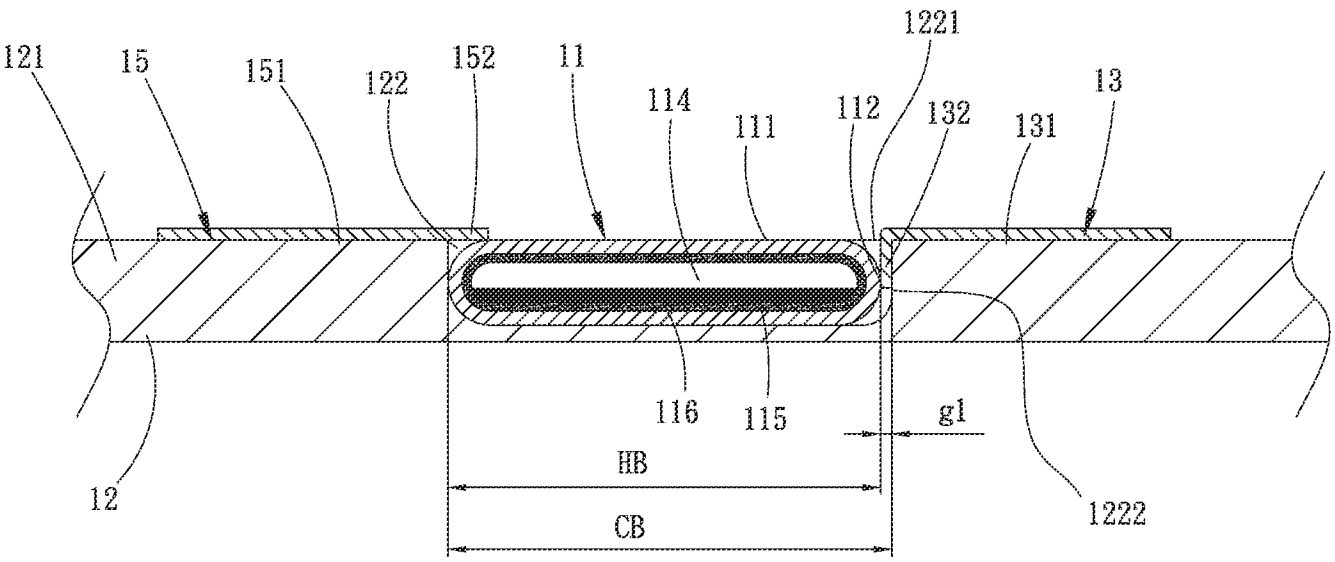
FIG. 4B is a fragmentary assembled sectional view of the fixing structure for heat dissipation element according to a fourth embodiment of the present invention.

Alternatively, as shown in FIG. 4B, which is a fragmentary assembled sectional view of the fixing structure according to a fourth embodiment of the present invention, the first fixing portion 131 of the first fixing member 13 and the second fixing portion 151 of the second fixing member 15 can be directly connected to the top surface 121 of the base plate 12 without the need of providing two shallow recesses on the base plate 12.

Like the first fixing member 13, the second fixing portion 151 of the second fixing member 15 is connected to the top surface 121 of the base plate 12 or fitted in the second shallow recess 126*b* by riveting, welding, bonding, spot welding, hooking, or snap fitting.

In the third and fourth embodiments illustrated in FIGS. 4A and 4B, respectively, the second outer lateral side 113 of the heat transfer element 11 is in contact with the second inner lateral side 1223 of the receiving recess 122. However, in a fifth and a sixth embodiment illustrated in FIGS. 5A and 5B, respectively, a second clearance g2 is defined between the second inner lateral side 1223 of the receiving recess 122 and the second outer lateral side 113 of the heat transfer element 11. In this case, like the first fixing member 13, the second extended portion 152 of the second fixing member 15 is bent and inserted into the second clearance g2, such that the second extended portion 152 of the second fixing member 15 is tightly fitted between the second inner lateral side 1223 of the receiving recess 122 and the second outer lateral side 113 of the heat transfer element 11.

In the illustrated fifth and sixth embodiments, the first extended portion 132 of the first fixing member 13 is tightly fitted between the first inner lateral side 1222 of the receiving recess 122 and the first outer lateral side 112 of the heat transfer element 11, and the second extended portion 152 of the second fixing member 15 is tightly fitted between the second inner lateral side 1223 of the receiving recess 122 and the second outer lateral side 113 of the heat transfer element 11, causing the heat transfer element 11 to be tightly held in the receiving recess 122. In other words, a sum of the thickness of the first and second extended portions 132, 152 and the width HB of the heat transfer element 11 is slightly larger than the width CB of the receiving recess 122, so that the first and second extended portions 132, 152 and the heat transfer element 11 can be tightly fitted in the receiving recess 122.

Figure 5A:
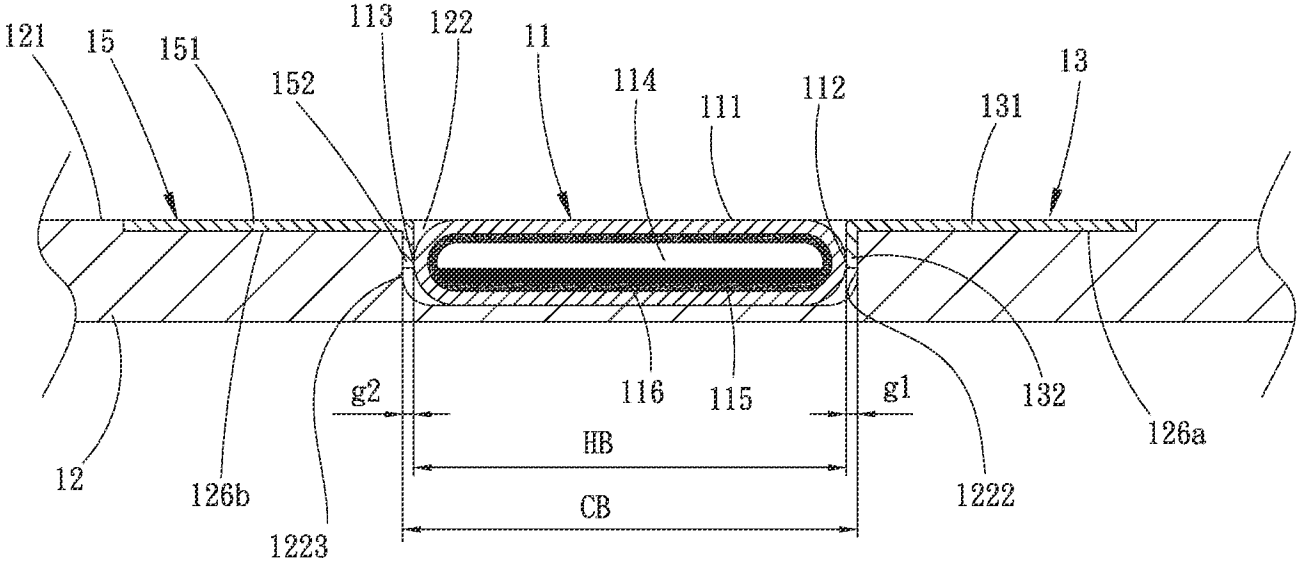
FIG. 5A is a fragmentary assembled sectional view of the fixing structure for heat dissipation element according to a fifth embodiment of the present invention.
Figure 5B:
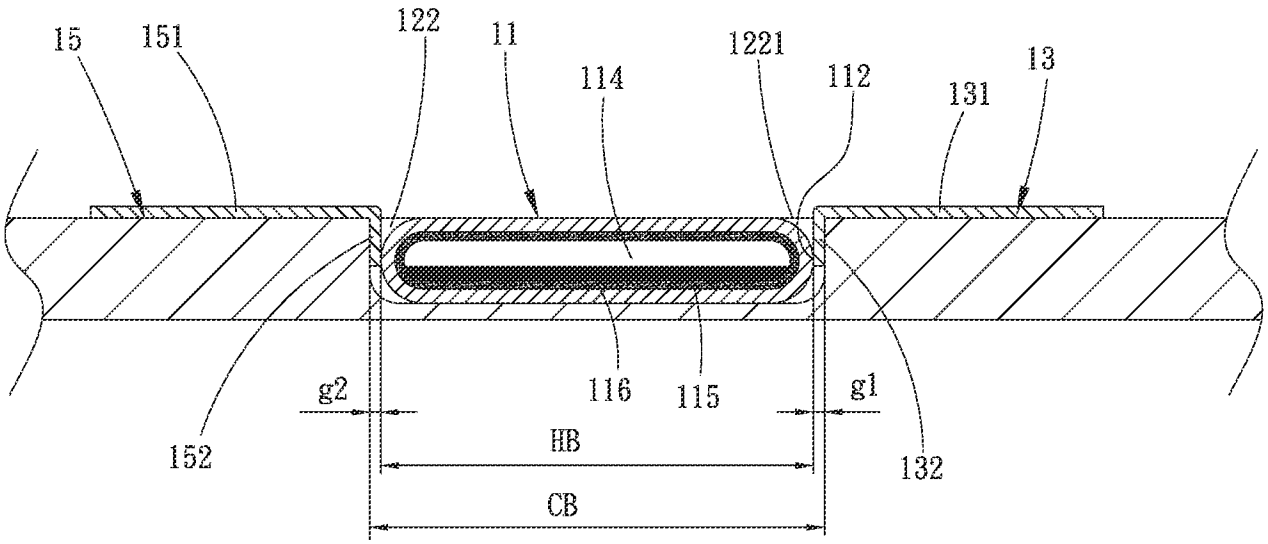
FIG. 5B is a fragmentary assembled sectional view of the fixing structure for heat dissipation element according to a sixth embodiment of the present invention.
Figure 6A:
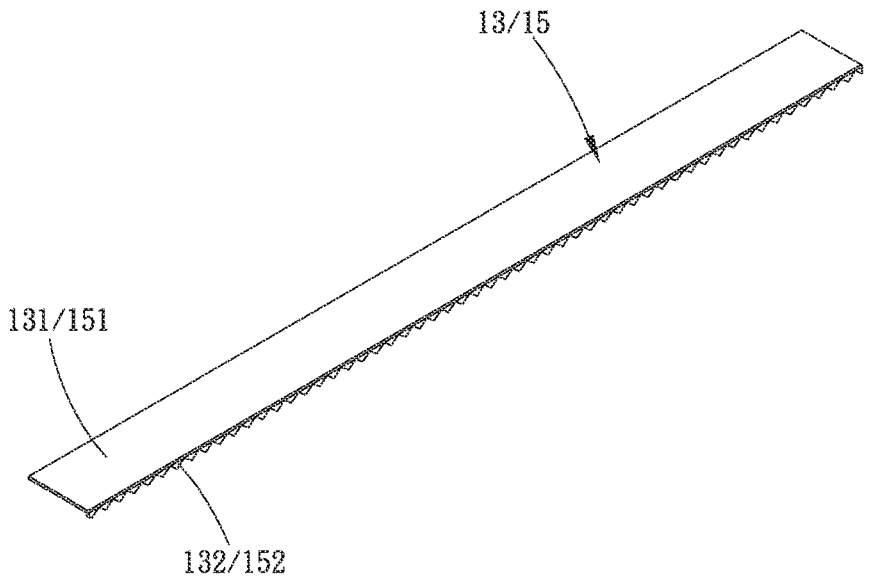
FIGS. 6A to 6D are perspective views showing four variants of a first and a second fixing member included in the fixing structure of the present invention.
Figure 6B:
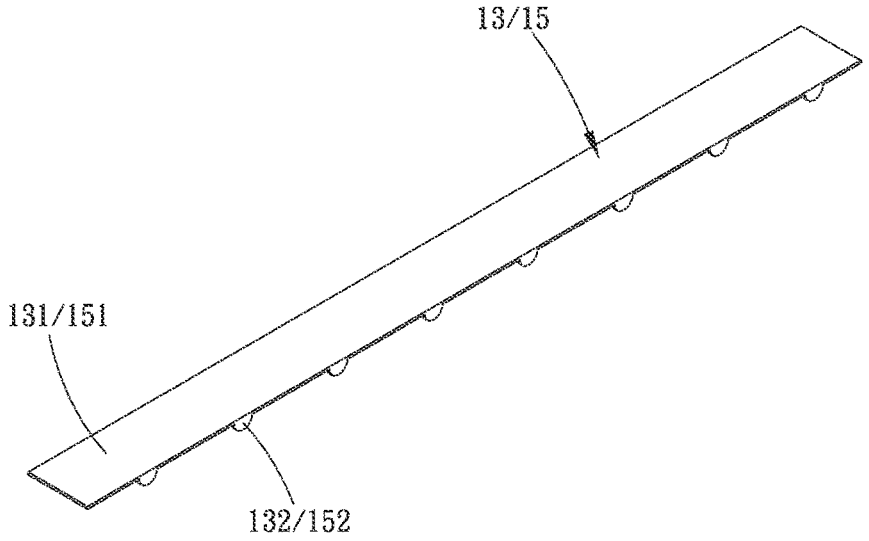
Figure 6C:
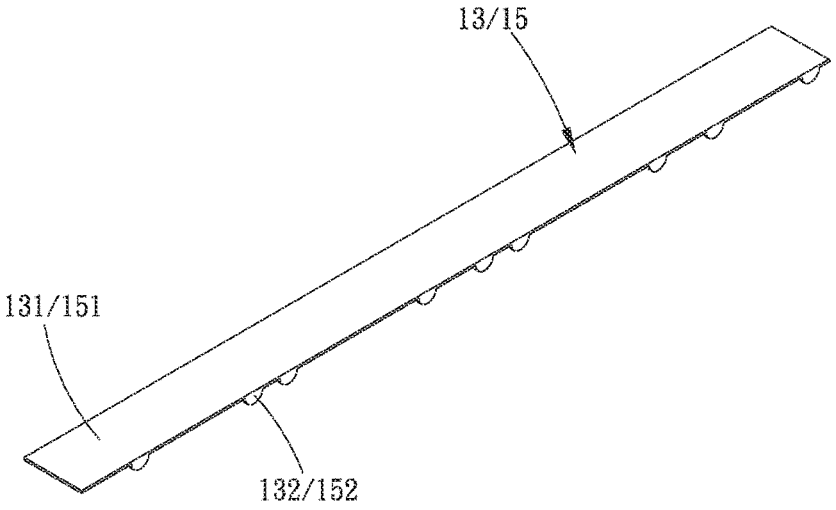
Figure 6D:
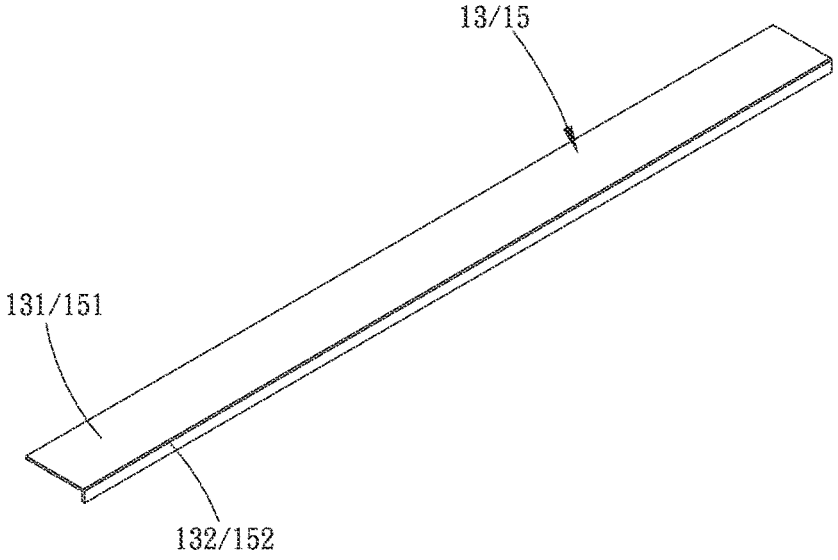

Please refer to FIGS. 6A to 6D, which are perspective views showing four variants of the first and the second fixing member 13, 15 included in the fixing structure of the present invention. As shown, both the first extended portion 132 of the first fixing member 13 and the second extended portion 152 of the second fixing member 15 can be differently configured. For example, the first and the second extended portion 132, 152 may respectively be a plurality of continuously arranged saw teeth, as shown in FIG. 6A, or be a plurality of equally spaced teeth, as shown in FIG. 6B, or be a plurality of irregularly spaced teeth, as shown in FIG. 6C, or simply be a long strip, as shown in FIG. 6D. The configurations of the first and the second extended portion 132, 152 can be changed according to the width HB of the heat transfer element 11, as shown in FIGS. 2A, 2B, 4A, 4B, 5A, and 5B, or a wall thickness of the heat transfer element 11 defined between the outer surface 111 and the chamber 114 of the heat transfer element 11 for isolating the chamber 114 from external environment, or can be determined according to the manner in which the heat transfer element 11 is to be fitted in the receiving recess 122.

The following is a description of the manner in which the fixing structure of the present invention is assembled.

Figure 7:
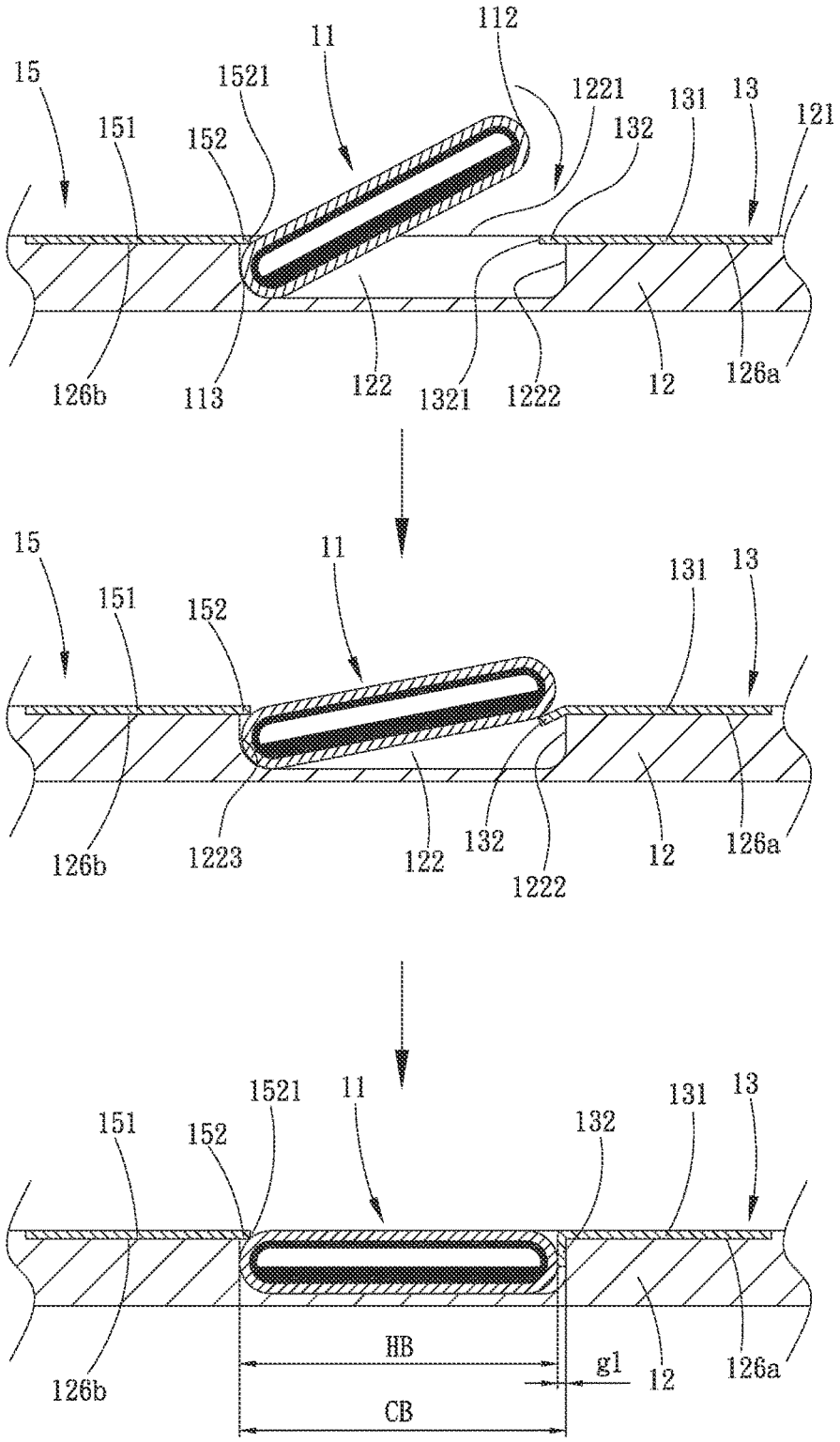
FIG. 7 shows the manner in which the fixing structure for heat dissipation element of FIG. 4A is assembled.

Please refer to FIG. 7, which shows the manner in which the fixing structure of FIG. 4A is assembled. As shown, the first and the second fixing member 13, 15 are first respectively connected to the top surface 121 of the base plate 12, such that the first and the second fixing portion 131, 151 are fixedly fitted in the first and the second shallow recess 126*a*, 126*b*, respectively, and the first and the second extended portion 132, 152 are horizontally extended beyond the first and the second inner lateral side 1222, 1223 of the receiving recess 122 into the top opening 1221. It is noted a distance between a free edge 1321 of the first extended portion 132 and a free edge 1521 of the second extended portion 152 is smaller than the receiving recess width CB. Then, the heat transfer element 11 is slantingly directed into the receiving recess 122, such that the second outer lateral side 113 of the heat transfer element 11 can be moved into the receiving recess 122 to press against the second inner lateral side 1223 of the receiving recess 122 without being interfered by the second extended portion 152 of the second fixing member 15.

Then, the first outer lateral side 112 of the heat transfer element 11 is downwardly pressed into the receiving recess 122. When doing so, the first outer lateral side 112 of the heat transfer element 11 naturally presses the first extended portion 132 of the first fixing member 13 downwardly to bend the same by an angle equal to or larger than 90 degrees, such that the first extended portion 132 of the first fixing member 13 is located between the first inner lateral side 1222 of the receiving recess 122 and the heat transfer element 11. After the heat transfer element 11 is fitted in the receiving recess 122, the first clearance g1 is defined between the first outer lateral side 112 of the heat transfer element 11 and the first inner lateral side 1222 of the receiving recess 122, and the first extended portion 132 is inserted in the first clearance g1, bringing the heat transfer element 11 to be tightly held in the receiving recess 122.

Figure 8:
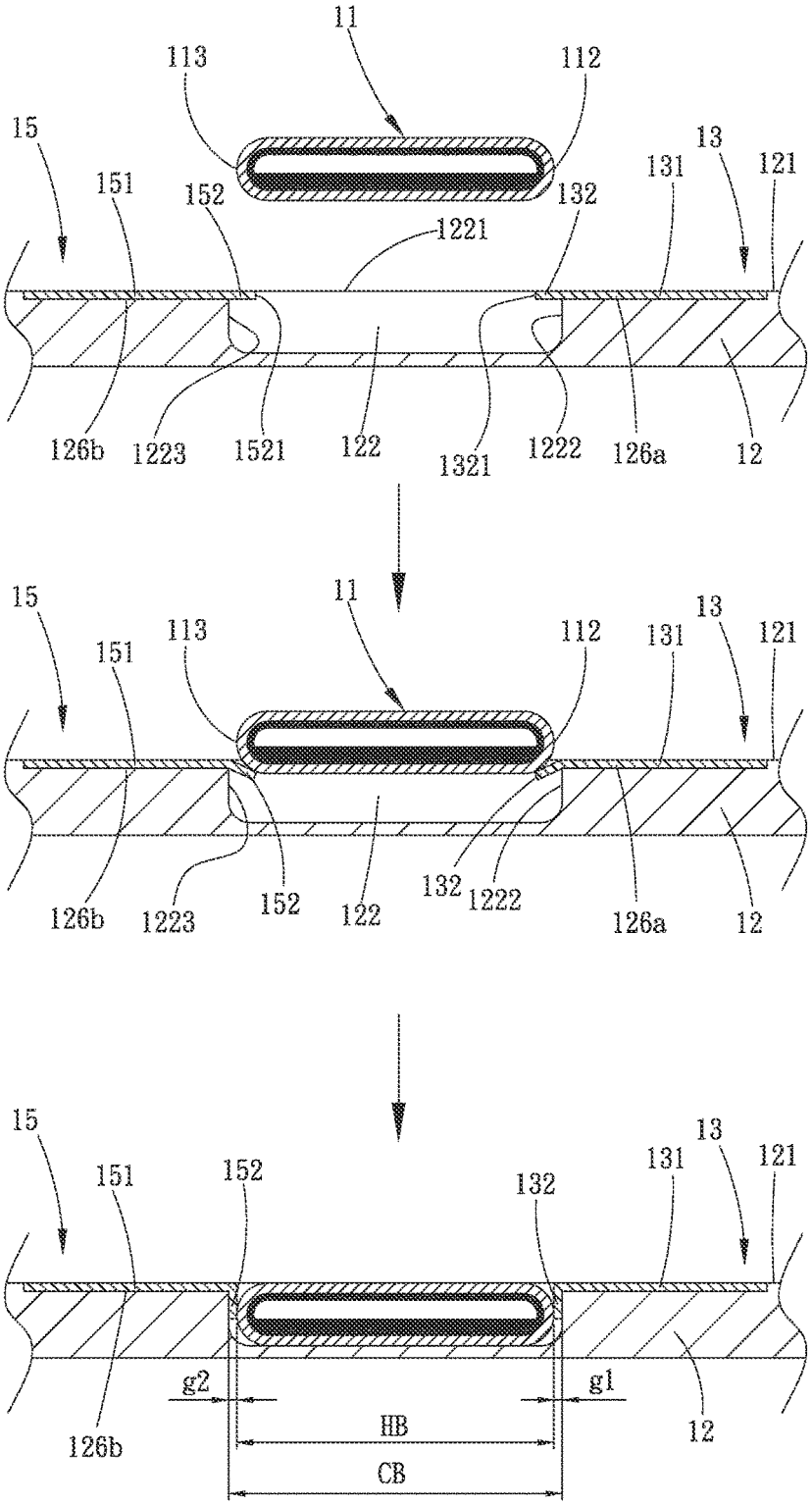
FIG. 8 shows the manner in which the fixing structure for heat dissipation element of FIG. 5A is assembled.

Please refer to FIG. 8, which shows the manner in which the fixing structure of FIG. 5A is assembled. As shown, the first and the second fixing member 13, 15 are first respectively connected to the top surface 121 of the base plate 12, such that the first and the second fixing portion 131, 151 are fixedly fitted in the first and the second shallow recess 126*a*, 126*b*, respectively, and the first and the second extended portion 132, 152 are horizontally extended beyond the first and the second inner lateral side 1222, 1223 of the receiving recess 122 into the top opening 1221. It is noted a distance between a free edge 1321 of the first extended portion 132 and a free edge 1521 of the second extended portion 152 is smaller than the receiving recess width CB. Then, the heat transfer element 11 is horizontally positioned and downwardly pressed into the receiving recess 122. When doing so, the first outer lateral side 112 of the heat transfer element 11 naturally presses the first extended portion 132 of the first fixing member 13 downwardly to bend the same by an angle equal to or larger than 90 degrees, whereas the second outer lateral side 113 of the heat transfer element 11 naturally presses the second extended portion 152 of the second fixing member 15 downwardly to bend the same by an angle equal to or larger than 90 degrees, such that the first extended portion 132 of the first fixing member 13 and the second extended portion 152 of the second fixing member 15 are respectively located between the receiving recess 122 and the first and second outer lateral sides 112, 113 of the heat transfer element 11.

After the heat transfer element 11 is fitted in the receiving recess 122, the first clearance g1 is defined between the first outer lateral side 112 of the heat transfer element 11 and the first inner lateral side 1222 of the receiving recess 122, whereas the second clearance g2 is defined between the second outer lateral side 113 of the heat transfer element 11 and the second inner lateral side 1223 of the receiving recess 122, and the first extended portion 132 is inserted in the first clearance g1 while the second extended portion 152 is inserted in the second clearance g2, bringing the heat transfer element 11 to be tightly held in the receiving recess 122.

By inserting the fixing member in at least one clearance formed between the receiving recess and the heat transfer element, the heat transfer element can be tightly fitted in the receiving recess without causing damage to it, while the production process can be shortened and the manufacturing cost can be reduced.

Furthermore, in an operable embodiment of the present invention, the first and the second fixing member 13, 15 can be integrally formed, such that the first extended portion 132 of the first fixing member 13 and the second extended portion 152 of the second fixing member 15 are connected to each other.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fixing structure for a heat dissipation element, comprising:

a heat transfer element having an outer surface, on which a rightmost outer side and a leftmost outer side are defined, and a width of the heat transfer element being defined between the rightmost outer side and the leftmost outer side;

a base plate having a top surface, on which a receiving recess is defined for receiving the heat transfer element therein; the receiving recess having a top opening, a rightmost inner side, and a leftmost inner side located opposite to the rightmost inner side; the rightmost inner side being located corresponding to the rightmost outer side of the heat transfer element, whereas the leftmost inner side being located corresponding to the leftmost outer side of the heat transfer element; a width of the receiving recess being defined between the rightmost inner side and the leftmost inner side and being larger than the width of the heat transfer element, such that a first clearance is defined between one of the leftmost inner side or the rightmost inner side of the receiving recess and a corresponding one of the leftmost outer side or the rightmost outer side of the heat transfer element; and a first fixing member having a first fixing portion and a first bent portion extended and bent from the first fixing portion; and the first fixing portion being disposed on the top surface of the base plate, whereas the first bent portion is inserted into the first clearance, such that the first bent portion is tightly fitted between the one of the leftmost inner side or the rightmost inner side of the receiving recess and the corresponding one of the leftmost outer side or the rightmost outer side of the heat transfer element; and wherein the base plate further has a first shallow recess defined on the top surface and the first shallow recess extends to the receiving recess, and the first fixing portion of the first fixing member being disposed in the first shallow recess, such that the first fixing portion of the first fixing member has an up face entirely coplanar with the top surface of the base plate, and wherein the fixing member extends only partially across the width of the receiving recess.

2. The fixing structure as claimed in claim 1, further comprising a second fixing member, which has a second fixing portion connected to the top surface of the base plate and a second extended portion extended from the second fixing portion into the top opening of the receiving recess.

3. The fixing structure as claimed in claim 2, wherein a second clearance is defined between the other one of the leftmost inner side or the other one of the rightmost inner side of the receiving recess and the corresponding other one of the leftmost outer side or the corresponding other one of the rightmost outer side of the heat transfer element; and the second extended portion of the second fixing member being bent and inserted into the second clearance, such that the second extended portion is tightly fitted between the other one of the leftmost inner side or the other one of the rightmost inner side of the receiving recess and the corresponding other one of the leftmost outer side or the corresponding other one of the rightmost outer side of the heat transfer element.

4. The fixing structure as claimed in claim 3, wherein the base plate further has a second shallow recess defined on the top surface and located adjacent to the other one of the leftmost inner side or the other one of the rightmost inner side of the receiving recess; the second shallow recess respectively having a depth smaller than that of the receiving recess; and the second fixing portion of the second fixing member being fitted in the second shallow recess.

5. The fixing structure as claimed in claim 4, wherein the second extended portion of the second fixing member has a configuration selected from the group consisting of a plurality of continuously arranged saw teeth, a plurality of equally spaced teeth, a plurality of irregularly spaced teeth, and a long strip.

6. The fixing structure as claimed in claim 3, wherein the second extended portion of the second fixing member has a configuration selected from the group consisting of a plurality of continuously arranged saw teeth, a plurality of equally spaced teeth, a plurality of irregularly spaced teeth, and a long strip.

7. The fixing structure as claimed in claim 2, wherein the base plate further has a second shallow recess defined on the top surface and located adjacent to the other one of the leftmost inner side or the other one of the rightmost inner side of the receiving recess; the second shallow recess respectively having a depth smaller than that of the receiving recess; and the second fixing portion of the second fixing member being fitted in the second shallow recess.

8. The fixing structure as claimed in claim 7, wherein the second extended portion of the second fixing member has a configuration selected from the group consisting of a plurality of continuously arranged saw teeth, a plurality of equally spaced teeth, a plurality of irregularly spaced teeth, and a long strip.

9. The fixing structure as claimed in claim 2, wherein the second extended portion of the second fixing member has a free edge pressed against the outer surface of the heat transfer element.

10. The fixing structure as claimed in claim 2, wherein the second extended portion of the second fixing member has a configuration selected from the group consisting of a plurality of continuously arranged saw teeth, a plurality of equally spaced teeth, a plurality of irregularly spaced teeth, and a long strip.

11. The fixing structure as claimed in claim 1, wherein the heat transfer element is selected from the group consisting of a heat pipe and a vapor chamber.

12. The fixing structure as claimed in claim 1, wherein the first bent portion of the first fixing member has a configuration selected from the group consisting of a plurality of continuously arranged saw teeth, a plurality of equally spaced teeth, a plurality of irregularly spaced teeth, and a long strip.

* * * * *